US005629906A

United States Patent [19]

Sudol et al.

[11] Patent Number: 5,629,906

[45] Date of Patent: May 13, 1997

[54] ULTRASONIC TRANSDUCER

[75] Inventors: Wojtek Sudol, Burlington; Francis E. Gurrie, Ipswich; Larry A. Ladd, Lawrence, all of Mass.

[73] Assignee: Hewlett-Packard Company, Palo Alto, Calif.

[21] Appl. No.: 389,536

[22] Filed: Feb. 15, 1995

[51] Int. Cl.[6] ..... H04R 17/00

[52] U.S. Cl. ..... 367/162; 367/176; 367/151; 310/326; 310/327; 310/335

[58] Field of Search ..... 367/151, 162, 367/176; 310/326, 327, 335

[56] References Cited

U.S. PATENT DOCUMENTS

| | | | |
|---|---|---|---|
| 4,166,967 | 9/1979 | Benes et al. | 310/338 |
| 5,267,221 | 11/1993 | Miller et al. | 367/140 |

*Primary Examiner*—J. Woodrow Eldred

[57] ABSTRACT

An acoustic transducer includes a support structure which holds an acoustic pulse generator having both a front application face and a rear face. An acoustic absorber is attached to the rear face of the pulse generator. An acoustic isolator is positioned between the acoustic absorber and a support structure/heat sink. A preferred embodiment of the acoustic isolator includes at least a first material layer exhibiting a first acoustic impedance value, and a second material layer exhibiting a second acoustic impedance value. The second acoustic impedance value is substantially different from the first acoustic impedance value. A boundary between the first material layer and the second material layer causes multiple acoustic reflections of an acoustic pulse emanating from the rear face of the pulse generator. The first material layer and second material layer both exhibit substantial heat transfer capabilities. The acoustic isolator acts as a multiple reflective layer and prevents a substantial percentage of rear propagated acoustic energy from entering and being reflected by the support structure, thereby greatly reducing ultrasound display artifacts. A further embodiment of the acoustic isolator includes a single acoustic isolator layer and employs the support structure as a second layer.

14 Claims, 4 Drawing Sheets

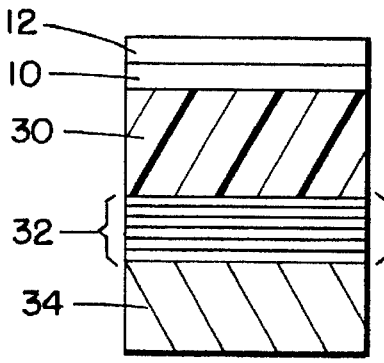
FIG. 5.
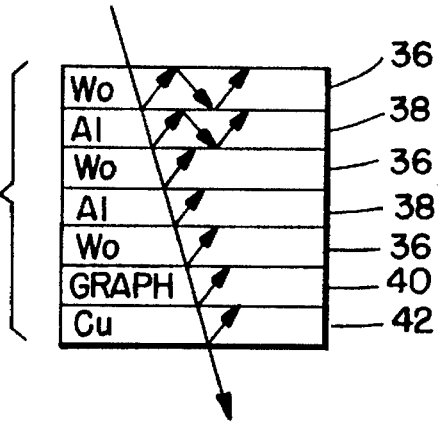
FIG. 5A.
FIG. 6.
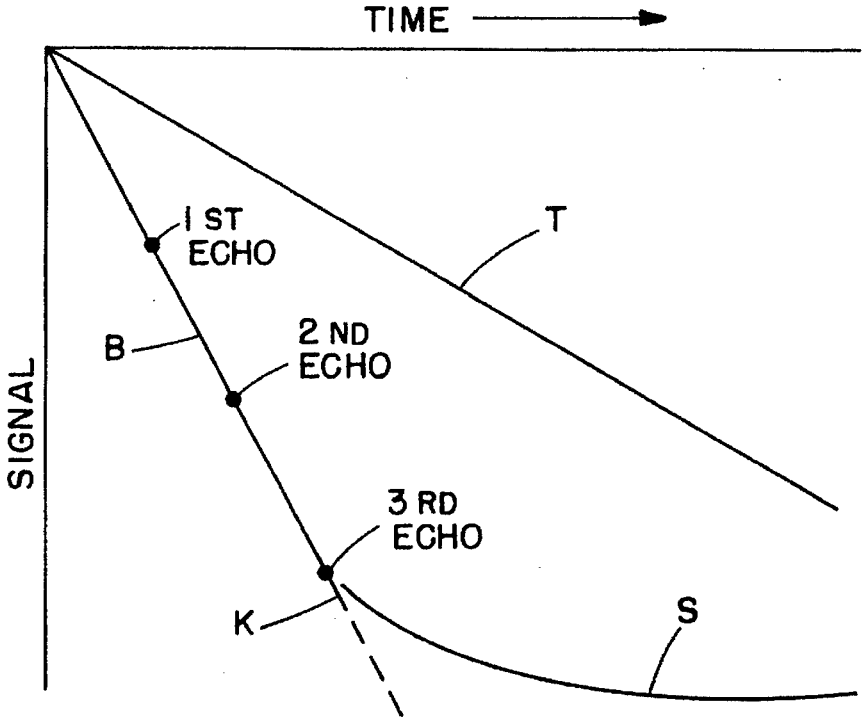

ULTRASONIC TRANSDUCER

FIELD OF THE INVENTION

This invention relates to ultrasonic transducers and, more particularly, to an ultrasonic transducer which has a thin aspect ratio, yet exhibits effective noise attenuation.

BACKGROUND OF THE INVENTION

Medical ultrasound transducers send repeated acoustic pulses into a body with a typical pulse length of less than a microsecond, using a typical repetition time of 160 microseconds. This is equivalent to approximately a 12 centimeter penetration in human tissue. After sending each pulse, the systems listens for incoming body echoes. The echoes are produced by acoustic impedance mismatches of different tissues which enable both partial transmission and partial reflection of the acoustic energy.

As a result of the body's acoustic attenuation properties, echoes coming from greater depths are more attenuated than echoes coming from shallower depths. The signal decay rate in the human body is approximately 0.38 dB per microsecond. Modern ultrasound systems compensate for this signal decay rate by employing variable automatic gain controls which operate, for example, in proportion to the depth of a returned signal.

Referring to FIG. 1, a schematic of a prior art ultrasound transducer 8 is shown which includes a pulse generator 10 and a matching layer 12 for coupling ultrasound signals into a patient's body. An acoustic absorber backing 14 and support 15 are positioned behind pulse generator 10. Transducer 8 includes an application face 16 which is placed against the patient's body and from which the principal ultrasound pulses emanate. Pulse generator 10 also propagates pulses through rear face 18 into absorber backing 14. Echoes coming from support 15 are not desired because such echoes appear on the ultrasound display as noise artifacts. As a result, the attenuation rate of absorber backing 14 has to be high to prevent such echoes from appearing on a display screen.

When a pulse generator 10 is energized, a sound signal T is emitted in a forward direction and is reflected by body Tissue, whereas a sound signal B is transmitted in the rearward direction through absorber backing 14, reflected by support 15 and redirected in a forward direction. FIG. 2 is a schematic of reflected signal level vs. time and indicates the size of signal T as reflected from the body tissue vs. the size of the signal in absorber backing B as reflected from support 15. The difference in magnitude in signals T and B is achieved by making the attenuation of absorber backing 14 greater than the attenuation of sound in the body. Note that the sound in absorber backing 14 keeps bouncing back and forth between support 15 and pulse generator 10 until it is entirely absorbed.

It has been found, that when support 15 is attached to absorber backing 14, artifacts sometimes appear on the ultrasound display screen during imaging. This is particularly the case when transducer 8 is thin and when heat sinks (which are relatively thick) are used as backing support. A thin transducer is generally desired in order to make the overall transducer smaller and more easily handleable.

Due to the lessened thickness of absorber backing 14, the round trip attenuation of sound within absorber backing 14 is lower in thin aspect ratio transducers as compared to the thicker variety. This causes more sound energy to be available at pulse generator 10 and thereby causes display artifacts. The attenuation level of absorber backing 14 dictates a minimum thickness transducer 8 which can be made without artifacts. It has also been determined that the shape of a rear-attached heat sink, its placement with respect to absorber backing 14 and the method of mounting the heat sink all effect the amount of displayed artifact. It has been thought that such display artifacts were due to mechanical resonances in the transducer structure and, while various changes in geometry and attachment methods between the heat sink and support body 15 have been tried, some display artifact from rear-reflected signals still remains.

Further analysis of the sound reflective characteristics of transducer 8 in FIG. 1, especially when it is configured as a "thin" transducer, indicate a second source of reflected sound (i.e. signal S) which results from reflections from the back of support 15. Signal S is later in time than signal B due to the increased travel distance through support 15.

FIG. 3 is a schematic of signal level at pulse generator 10 as a function of time, considering signals T, B and S. The signal level T from body Tissue is the same as described for FIG. 2. The decay rate of signal B from absorber backing 14 is initially slightly higher than that shown in FIG. 2 because some of the initial pulse energy is transmitted into support 15. While signal S is in the support 15, it does not decay with time. Thus, signal S, which comes from the back surface of support 15, decays at a lower rate than signal B (which is entirely in absorber backing 14). This action causes the overall level of signal at pulse generator 10 to decay much more slowly. The knee of curve K corresponds to the time it takes for the first echo S from within support 15 to reach the face of pulse generator 10. That time is proportional to the thickness of acoustic absorber backing 14. The slope of curve portion S, i.e. the decay rate of echoes from within support 15, is determined by the ratio of the thickness of support 15 divided by the thickness of absorber backing 14. Thus, the thicker is support 15 and the thinner is absorber backing 14, the more display artifact is present. The geometry is also important. If support 15 is wider than the backing (as shown in FIG. 1), the slope of S is also reduced.

The patented prior art includes many teachings regarding attenuation of rear-projected acoustic signals. In U.S. Pat. No. 5,267,221, entitled "Backing for Acoustic Transducer Array", an acoustically absorptive backing is described which includes electrical through-conductors for connecting ultrasound transducers to electrical contacts on a support. The absorptive backing is required to both absorb and attenuate acoustic signals coupled from the transducers and from the electrical through-conductors. One version of the invention (see FIG. 5) illustrates a dual layer absorptive backing wherein the layer adjacent to the transducers is designed to absorb and attenuate acoustic energy from the transducers and the layer adjacent the support is designed to absorb and attenuate acoustic energy from the electrical through-conductors.

There is a need for a thin aspect ratio ultrasound transducer which exhibits both excellent heat dissipation properties and provides effective attenuation of rear-transmitted acoustic energy.

SUMMARY OF THE INVENTION

An acoustic transducer includes a support structure which holds an acoustic pulse generator having both a front application face and a rear face. An acoustic absorber is attached to the rear face of the pulse generator. An acoustic isolator is positioned between the acoustic absorber and a support structure/heat sink. A preferred embodiment of the acoustic isolator includes at least a first material layer exhibiting a first acoustic impedance value, and a second material layer exhibiting a second acoustic impedance value. The second acoustic impedance value is substantially different from the first acoustic impedance value. Thus, at the boundary between the first material layer and the second material layer, most of the acoustic energy is reflected. The first material layer and second material layer both exhibit substantial heat transfer capabilities. In the case where there are several alternating layeres, the acoustic isolator acts as a multiple reflective layer and prevents a substantial percentage of rear propagated acoustic energy from entering and being reflected by the back of the support structure, thereby greatly reducing ultrasound display artifacts. A further embodiment of the acoustic isolator includes a single acoustic isolator layer and employs the support structure as a second layer. In this case, the acoustic impedance of the single layer is chosen to be as different as possible from the acoustic impedance of either the acoustic absorber or the support structure.

DESCRIPTION OF THE DRAWINGS

FIG. 5 is a schematic sectional view of an acoustic transducer incorporating the invention.

FIG. 5*a* is an expanded view of an acoustic isolator incorporated in the transducer of FIG. 5.

FIG. 6 is a plot of signal level versus time for the acoustic transducer structure of FIGS. 5 and 5*a*.

DETAILED DESCRIPTION OF THE PREFERRED EMBODIMENT

It has been found that if an acoustic pulse emanating from the rear face of an acoustic transducer encounters an acoustic isolator which causes reflections of the incident energy before it can reach a non-attenuating support, artifact elimination is achieved. A preferred embodiment of an acoustic isolator is achieved by providing multiple reflective layers between an acoustic absorber and the non-attenuating support. Each of the multiple reflective layers is highly thermally conductive and enables substantial heat transfer. Adjacent layers exhibit substantially different acoustic impedances. At each interface between layers, most of the acoustic pulse is reflected. When several layers are used, this action greatly reduces the amount of acoustic energy that enters the non-attenuating support. This process also creates many small reflected pulses from one large amplitude pulse, which small pulses are less likely to create artifacts than large amplitude pulses.

Figure 1:
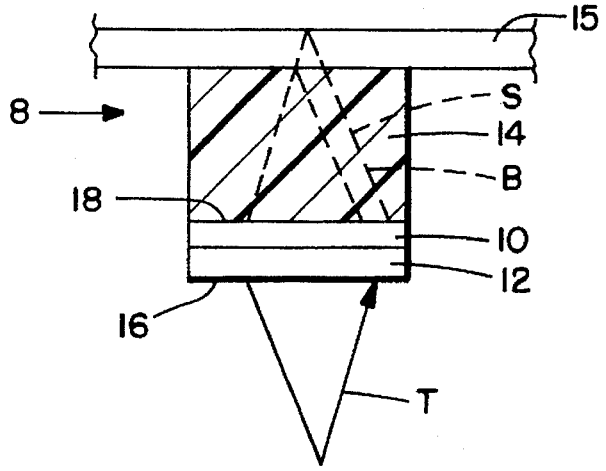
FIG. 1. (PRIOR ART)
FIG. 1 is a schematic sectional view of a prior art acoustic transducer.
Figure 2:
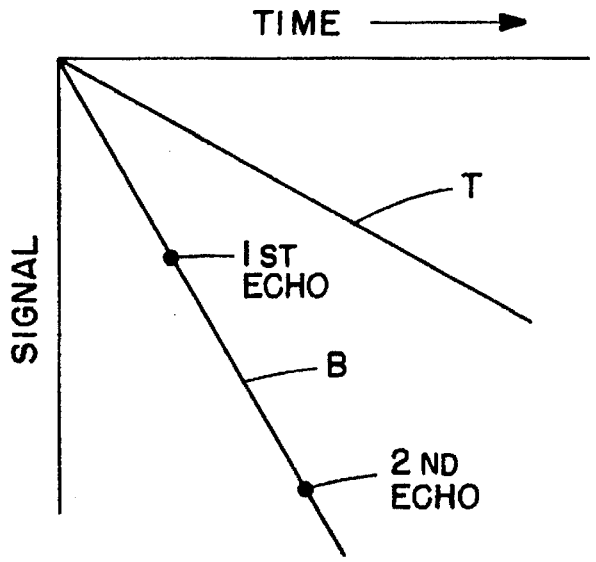
FIG. 2. (PRIOR ART)
FIG. 2 is a schematic of acoustic signal level versus time, that is useful in explaining the operation of the transducer of FIG. 1.
Figure 3:
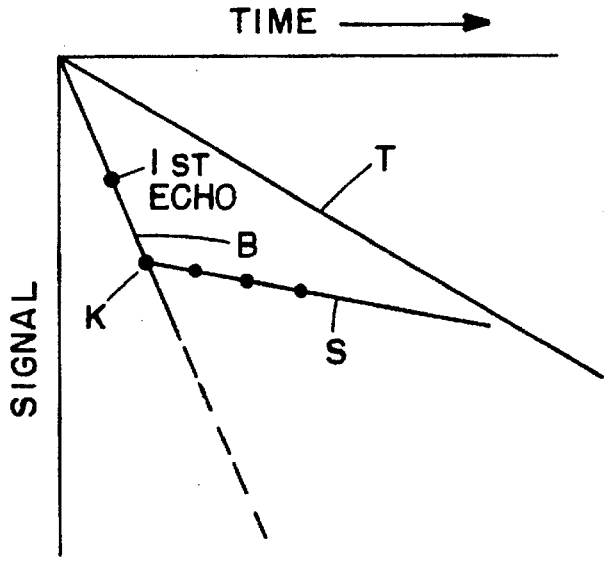
FIG. 3. (PRIOR ART)
FIG. 3 is a schematic of signal level versus time which indicates the effect of echo reflections from a non-acoustically absorbing support structure.
Figure 4:
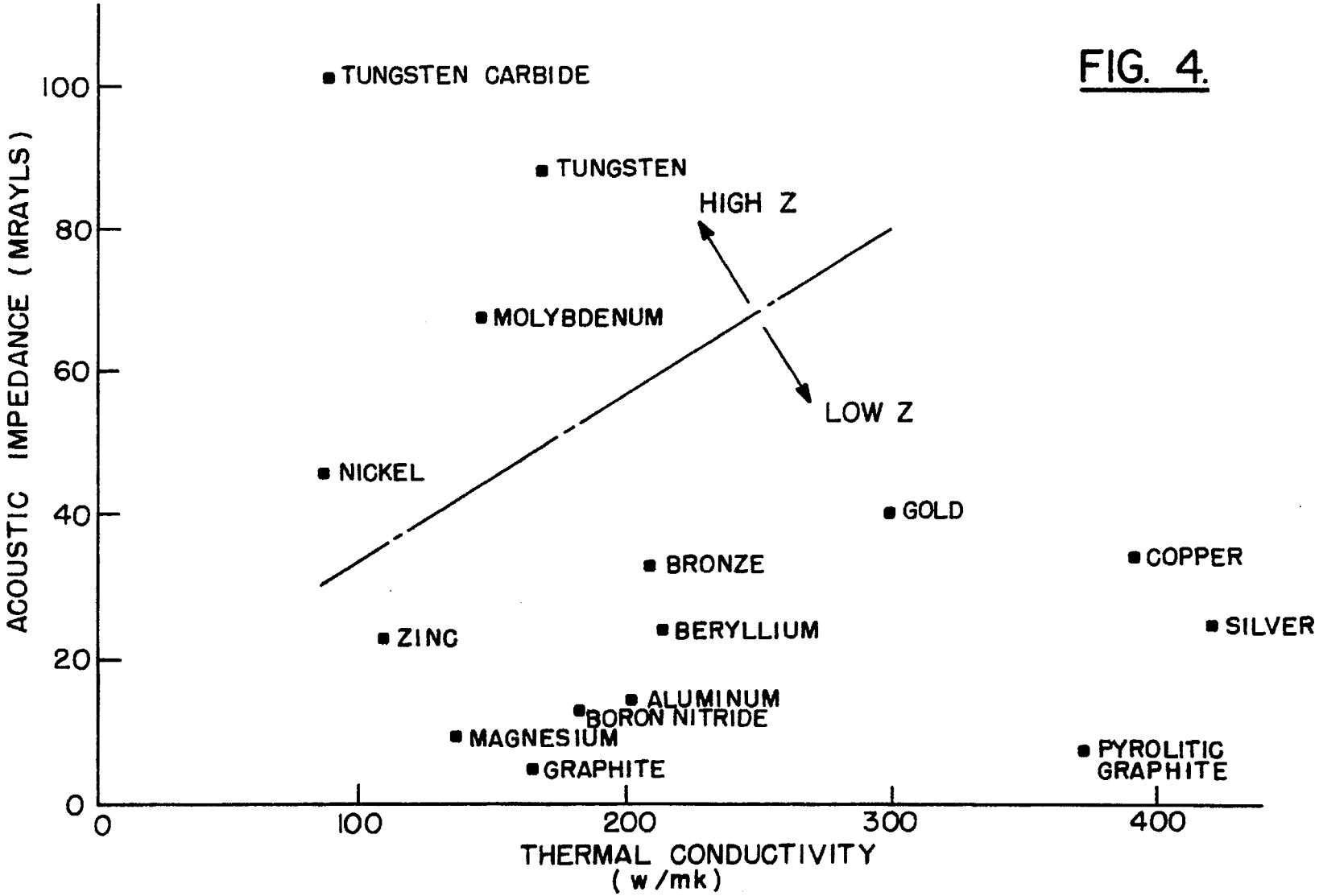
FIG. 4 is a plot of acoustic impedance versus thermal conductivity for various materials.

As is known to those skilled in the art, the acoustic impedance Z of a propagating medium is the product of the density of a medium and the speed of sound through the medium. The unit of acoustic impedance is the RAYL and its units are in $kg/m^2s$. In FIG. 4, a plot is shown of acoustic impedance versus thermal conductivity for various materials. As can be seen, tungsten carbide, tungsten, molybdenum and nickel exhibit relatively high acoustic impedances and good mid-level thermal conductivities. By contrast, zinc, magnesium, graphite, boron nitride, aluminum, beryllium, bronze, gold, copper, silver and pyrolitic graphite all exhibit relatively lower acoustic impedances and thermal conductivities in the medium to high range. As will be understood, the acoustic isolator employed with the acoustic transducer of this invention includes first sub-layers having a high acoustic impedance and interspersed second sub-layers with a lower acoustic impedance. This structure creates a boundary or boundaries that cause substantial reflections of incident acoustic pulses.

Turning to FIGS. 5 and 5*a*, pulse generator 10 and matching layer 12 are disposed on one surface of acoustic absorber backing 30. A multiply reflective acoustic isolator 32 is, in turn, positioned between a second surface of acoustic absorber backing 30 and a non-attenuating layer 34 (which may be a support structure, a heat sink or a combination thereof). Acoustic isolator 32 is shown in further detail in FIG. 5*a* and includes plural tungsten sub-layers 36 with interspersed aluminum sub-layers 38. A further graphite matching layer 40 and copper heat transfer layer 42 complete the structure of acoustic isolator 30. Graphite matching layer 40 and copper layer 42, while present in the embodiment shown in FIGS. 5 and 5*a*, are not necessarily required for operability of the invention.

FIG. 6 is a schematic of signals at pulse generator 10 versus time for the transducer structure shown in FIGS. 5 and 5*a*. Signal T from tissue is the same as for the above-described cases. Signal B from acoustic absorber backing 30 is also the same. However, acoustic isolator 32 greatly reduces the amount of sound energy that enters support 34, so the decay rate of signal B is slightly larger than the decay rate without acoustic isolator 32. However, signal S from support 34 is much lower due the isolating and multiple reflective sound trapping actions of acoustic absorber 32. As shown in FIG. 6, the S signal is not seen until the sound has bounced back and forth between pulse generator 10 and acoustic isolator 32 several times and is well below tissue echo T and does not produce artifacts. In the presence of acoustic isolater 32, the S signal exhibits a much lower amplitude than the T signal at all times of interest.

Acoustic Analysis

When a sound wave impinges on an interface between two different media, part of the incident wave is reflected and part is transmitted. For normal incidence of acoustic waves at a plane interface, the amplitude reflection coefficient R and transmission coefficient T are given by equations 1 and 2 below:

$$R=\frac{Z_2-Z_1}{Z_2+Z_1}=\frac{\rho_2C_2-\rho_1C_1}{\rho_2C_2+\rho_1C_1} \quad (1)$$

$$T=\frac{2Z_2}{Z_2+Z_1}=\frac{2\rho_2C_2}{\rho_2C_2+\rho_1C_1} \quad (2)$$

where:

ρ is the density;

C is the sound velocity;

Z is ρC which is the acoustic impedance of the medium.

As can be seen from equations 1 and 2, by choosing the acoustic impedance of adjacent sub-layers appropriately, the ratio of reflected to transmitted acoustic energy can be adjusted.

Preferred Materials and Structure

A preferred material for sub-layers 36 is tungsten, as it exhibits both good heat conductivity and a high acoustic impedance of 101 megarayls. A preferred material for sub-layers 38 is aluminum as it also exhibits a high heat conductivity and a low acoustic impedance of approximately 17 megarayls. As a result, at each interface between the tungsten and aluminum sub-layers, the amplitude of the reflection coefficient is 0.7 for incident ultrasound pulses. Thus, 50% of the energy is reflected and only 50% is transmitted. At each additional interface, 50% of the remaining signal is reflected. Note that acoustic isolator 32 does not act as an absorber but rather as a multiple reflection layer which essentially prevents a substantial percentage of an incident ultrasound pulse from entering non-attenuating support 34 and then entering back into absorber backing 30.

One skilled in the art will understand that two reflection sub-layers will cause the above-described multiple reflections and acoustic isolation. However, the preferred embodiment includes multiple reflective sub-layers to assure that the resulting sub-pulses are greatly reduced in amplitude (e.g. 50–60 dB).

It is preferred that each sub-layer 36 be bonded directly to a sub-layer 38 without intervening adhesive or other non-thermally conductive material. Thus, it is preferred that a diffusion bonding process be employed wherein the adjacent tungsten and aluminum layers are subjected to high contact pressure in a vacuum at an elevated temperature (e.g. 550° C.) for a period of a time to achieve the desired diffusion bond. If, as in the case of aluminum and tungsten, such a bond is difficult to achieve, the tungsten may be plated with a layer of nickel, with the nickel layer then being diffusion bonded to an adjacent aluminum layer. It is to be understood, however, that so long as a desired acoustic impedance difference, high thermal conductivity, and relative layer bondability is retained, that any combination of low Z and high Z reflective sub-layer materials can be employed.

Figure 7:
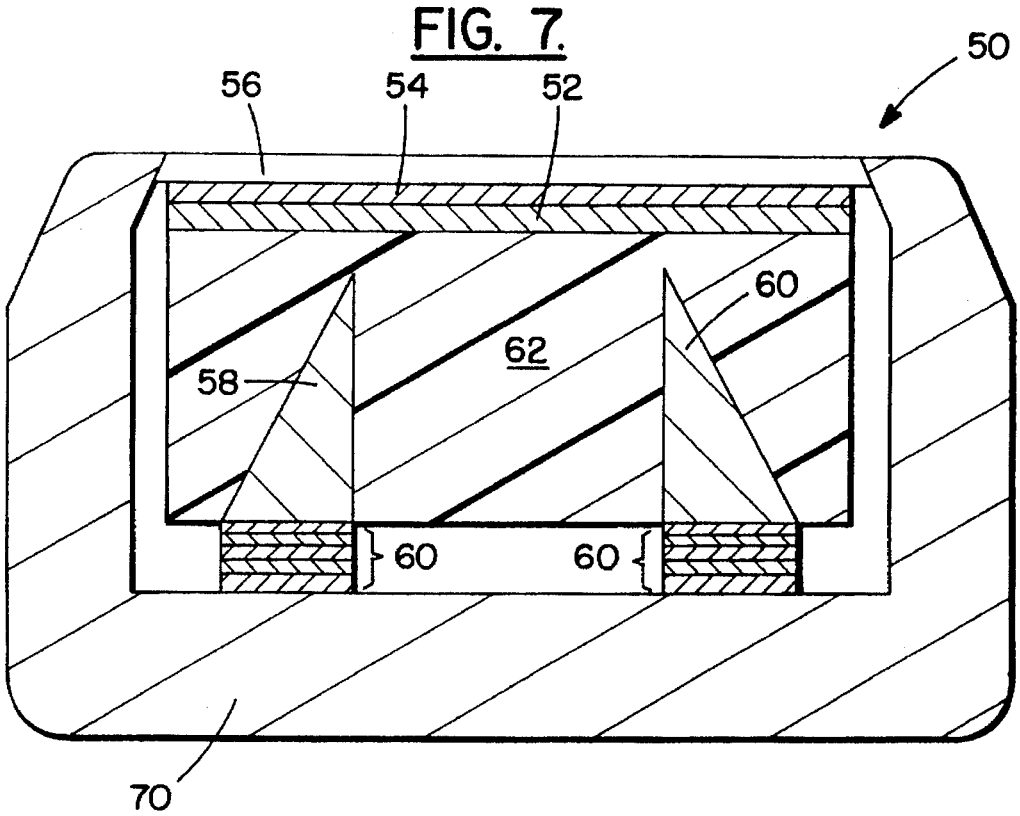
FIG. 7 is a partial sectional view of an acoustic transducer that employs an acoustic isolator embodying the invention hereof.
Figure 8:
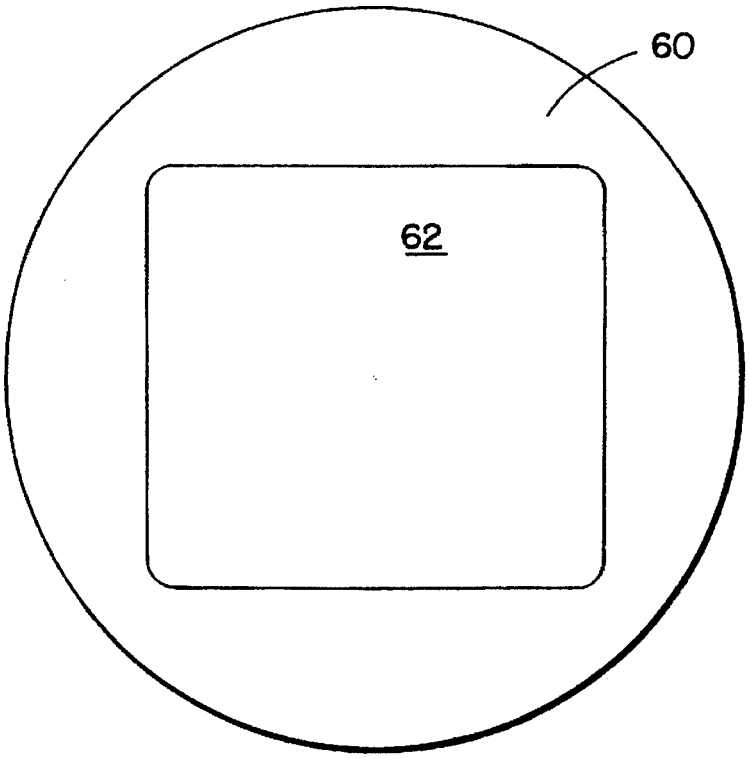
FIG. 8 is a plan view of the acoustic isolator used in the transducer of FIG. 7.

Turning to FIGS. 7 and 8, a preferred embodiment is shown of an acoustic transducer that includes an acoustic isolator 60. Acoustic transducer 50 includes a crystal resonator 52, a matching layer 54 and a lens 56. This embodiment includes heat sink arms 58 and 60 which extend into acoustic absorber 62 and rest upon acoustic isolator 60. Heat sink arms 58 and 60 exhibit a very thin cross-section (i.e., into the paper) and thus are volumetrically small when compared to the volume of acoustic absorber 60. Such configuration prevents heat sink arms 58 and 60 from themselves, creating substantial reflected artifacts. They do, however, improve the flow of heat from the pulse generator into acoustic isolator 60 and heat sink 70.

A plan view of acoustic isolator 60 is shown in FIG. 8 and includes a cut-out area 62 for required wiring and other mechanical elements present within transducer 50. Acoustic isolator 60, includes interspersed sub-layers of tungsten and aluminum.

The structure shown in FIG. 7 enables a reduction in the magnitude of rear face transmitted ultrasound signals by a level in excess of 55 dB in a slim aspect ratio acoustic transducer structure. Further, the structure exhibits substantial heat dissipation characteristics by virtue of the chosen materials.

The above description has considered a multiple layer acoustic isolator. A single layer acoustic isolator, while not as preferred, will also act to produce reflections which prevent much of the sound from entering the transducer support. Such a single layer acoustic isolator is positioned between the acoustic absorber and the transducer support. The acoustic impedance of the single layer acoustic isolator should be as different as possible from the acoustic impedance of the acoustic absorber and the transducer support.

It should be understood that the foregoing description is only illustrative of the invention. Various alternatives and modifications can be devised by those skilled in the art without departing from the invention. Thus, while the above discussion has referred to a medical ultrasound transducer, the invention is equally applicable to any ultrasound transducer that is used with an imaging system. Accordingly, the present invention is intended to embrace all such alternatives, modifications and variances which fall within the scope of the appended claims.

We claim:

1. An acoustic transducer comprising:

acoustic pulse generating means for producing pulses of acoustic energy and having a front application face and a rear face;

acoustic absorber means coupled to said rear face for absorbing a substantial portion of acoustic energy of pulses emerging from said rear face;

acoustically non-attenuative support means; and acoustic isolator means coupled between said acoustic absorber means and said acoustically non-attenuative support means, said acoustic isolator means including a first material sub-layer exhibiting a first acoustic impedance value and a second material sub-layer exhibiting a second acoustic impedance value that is substantially different from said first acoustic impedance value, said acoustic isolator means causing reflections of acoustic energy not absorbed by said acoustic absorber means to substantially reduce an amount thereof entering said support means.

2. The acoustic transducer as recited in claim 1 wherein both said first material sub-layer and said second material sub-layer exhibit substantial heat transfer capability.

3. The acoustic transducer as recited in claim 2 wherein said acoustic isolator means includes plural reflective sub-layers, each reflective sub-layer comprising a bonded pair of said first material sub-layer and said second material sub-layer.

4. The acoustic transducer as recited in claim 1 wherein said first material sub-layer is chosen from a group consisting of:

tungsten carbide, tungsten, molybdenum and nickel.

5. The acoustic transducer as recited in claim 4 wherein said second material sub-layer is selected from the group consisting of:

zinc, magnesium, graphite, boron nitride, aluminum, beryllium, bronze, gold, copper, silver, and pyrolitic graphite.

6. The acoustic transducer as recited in claim 2 wherein said first material sub-layer is tungsten and said second material layer is aluminum, said layers separated by a thin bond layer and connected via a thermal-compression bond.

7. An acoustic transducer comprising:

an acoustic pulse generator for producing pulses of acoustic energy and having a front application face and a rear face;

an acoustic absorber juxtaposed to said rear face for absorbing a substantial portion of acoustic energy of pulses emerging from said rear face;

plural metal heat transfer fingers embedded in said acoustic absorber; and a multilayer acoustic isolator coupled to said metal heat transfer fingers and between said acoustic absorber and an acoustically non-attenuative support/heat sink, said acoustic isolator including multiple sub-layers of a first material exhibiting a high acoustic impedance value, with interspersed second material sub-layers exhibiting a lower acoustic impedance value, both said first material sublayers and second material sublayers having substantial heat transfer capabilities, said multilayer acoustic isolator causing reflections of acoustic energy not absorbed by said acoustic absorber to substantially reduce an amount thereof entering said acoustically non-attenuative support/heat sink.

8. The acoustic transducer as recited in claim 7, wherein said first conductive material is aluminum and said second conductive material is tungsten.

9. The acoustic transducer as recited in claim 8, wherein said metal heat transfer fingers have a metal volume that is small so as to assure that acoustic reflections therefrom do not reach said acoustic pulse generator with a level of energy that causes substantial artifacts to be induced therein.

10. A method for reducing reflections from within a rear support structure in an acoustic transducer wherein an acoustic absorber is positioned within said acoustic transducer to absorb acoustic pulses generated by a pulse generator and directed towards said rear support structure, comprising the steps of:

positioning an acoustic isolator between said acoustic absorber and said rear support structure, said acoustic isolator including at least a first material sub-layer exhibiting a first acoustic impedance value and a second material sub-layer exhibiting a second acoustic impedance value that is substantially different from said first acoustic impedance value; and inducing said pulse generator to produce an acoustic pulse which is projected towards said acoustic isolator, a substantial portion of energy in said acoustic pulse being absorbed by said acoustic absorber, said acoustic isolator subjecting unabsorbed portions of said acoustic pulse to multiple reflections which prevent entry of a substantial proportion of said acoustic pulse into said rear support structure.

11. An acoustic transducer comprising:

acoustic pulse generating means for producing pulses of acoustic energy and having a front application face and a rear face;

acoustic absorber means coupled to said rear face for absorbing acoustic energy of pulses emerging from said rear face;

support means exhibiting a first acoustic impedance; and acoustic isolator means coupled between said acoustic absorber means and said support means, said acoustic isolator means exhibiting a low attenuation of said acoustic energy and a second acoustic impedance value that is substantially different from said first acoustic impedance value, a boundary between said support means and said acoustic isolator means reflecting acoustic energy not absorbed by said acoustic absorber means back towards said acoustic absorber means.

12. The acoustic transducer as recited in claim 11 wherein at least said acoustic isolator means exhibits substantial heat transfer capability.

13. The acoustic transducer as recited in claim 12 wherein said acoustic isolator means is comprised of a material that is chosen from a group consisting of:

tungsten carbide, tungsten, molybdenum and nickel.

14. The acoustic transducer as recited in claim 12 wherein said acoustic isolator means is comprised of a material selected from the group consisting of:

zinc, magnesium, graphite, boron nitride, aluminum, beryllium, bronze, gold, copper, silver, and pyrolitic graphite.

* * * * *